10/15/85 4,546,582

United States Patent [19]

Gartner

[11] Patent Number: 4,546,582

[45] Date of Patent: Oct. 15, 1985

[54] UNIT CURTAIN WALL

[75] Inventor: Karl Gartner, Gundelfingen, Fed. Rep. of Germany

[73] Assignee: Yoshida Kogyo K. K., Tokyo, Japan

[21] Appl. No.: 517,505

[22] Filed: Jul. 26, 1983

[30] Foreign Application Priority Data

Aug. 2, 1982 [JP] Japan ..... 57-133768

[51] Int. Cl.[4] ..... E04H 1/00

[52] U.S. Cl. ..... 52/235; 52/483; 52/573

[58] Field of Search ..... 52/235, 483, 167, 573, 52/64, 486, 506, 510, 511, 134

[56] References Cited

FOREIGN PATENT DOCUMENTS 2364224 11/1975 Fed. Rep. of Germany ..... 52/235

1472528 1/1967 France ..... 52/235

*Primary Examiner*—Carl D. Friedman

*Assistant Examiner*—Naoko N. Slack

*Attorney, Agent, or Firm*—Hill, Van Santen, Steadman & Simpson

[57] ABSTRACT

Horizontally adjacent curtain wall units are supported by a fastener on a building skeleton frame. The fastener includes a first fastener member adjustably fastened to the building frame and a second fastener member adjustably attached to the first fastener member and having a slot and a bearing element. The curtain wall units include confronting vertical frame members with brackets fastened thereto, respectively. One of the brackets has an arm engaging in the slot and the other bracket also has an arm movably supported on the bearing element. The bearing element may comprise a roller or a ball for allowing the other bracket and hence the vertical frame member attached thereto to move in a horizontal direction parallel to the curtain wall units.

7 Claims, 6 Drawing Figures

UNIT CURTAIN WALL

BACKGROUND OF THE INVENTION

1. Field of the Invention

The present invention relates to a unit curtain wall composed of a plurality of curtain wall units adjustably connected to and hung by fasteners on the exterior structural frame of a building.

2. Description of the Prior Art

Known unit curtain walls are assemblies of curtain wall units, each of which has lateral vertical frame members attached by fasteners to a building skeleton frame. Non-load-bearing curtain wall structure tends to be displaced between building floors when the building is subjected to an earthquake, for example. Since the curtain wall units are mounted individually to the building frame, they are liable to move through different intervals dependent on how they are attached and on their varying inertial forces. Safety requires that the curtain wall units be installed on the building frame by connector arrangements which take up such different displacements of the curtain wall units to cancel out any unwanted impact forces which would otherwise damage the curtain wall units. Conventional connector arrangements however have been quite complex in joining the building skelton frame to the fasteners, and the fasteners to the vertical frame members of the curtain wall units.

SUMMARY OF THE INVENTION

It is an object of the present invention to provide a unit curtain wall having curtain wall units connected to a building frame by fasteners capable of quickly absorbing displacements of the curtain wall units between building floors, thereby cancelling out undesirable impact forces on the curtain wall units.

Another object of the present invention is to provide a unit curtain wall with curtain wall units thereof connected to relatively simple fasteners.

Still another object of the present invention is to provide utilized curtain wall structure which can be attached to a building skeleton frame through a simple procedure.

According to the present invention, each pair of horizontally adjacent curtain wall units is supported by a fastener on a building skeleton frame. The curtain wall units have brackets, respectively, fastened to their confronting vertical frame members and including arms, respectively. The fastener includes a first fastener member adjustably fastened to the building frame and a second fastener member adjustably attached to the first fastener member and having a slot and a bearing element in the form of a roller or a ball. One of the arms engages in the slot and the other arm is movably supported on the bearing element. The bearing element allows the bracket and hence the vertical frame member attached thereto to move horizontally parallel to the curtain wall units.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Throughout the specification, the terms "inner", "outer", "inwardly", and "outwardly" are used with reference to the geometric center of a building to which a unit curtain wall is to be attached.

Figure 1:
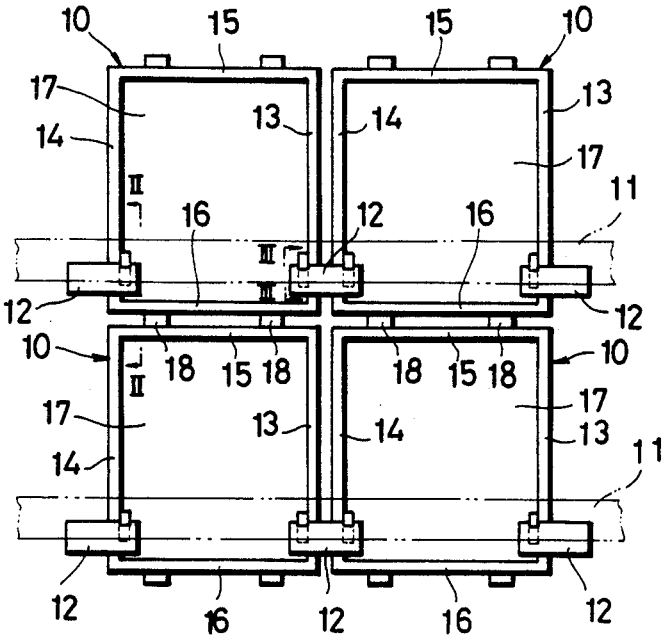
FIG. 1 is a fragmentary rear elevational view of a unit curtain wall according to the present invention as viewed from the interior of a building.

As shown in FIG. 1, a curtain wall comprises a plurality of curtain wall units 10 connected to and hung on building skeleton frame members 11 by a plurality of fasteners 12. The building skeleton frame members 11 are spaced vertically and serve as bases for building floors. Each of the curtain wall units 10 is composed of a pair of lateral vertical members 13, 14, a pair of upper and lower horizontal members 15, 16 extending between and interconnecting the lateral vertical members 13, 14 to provide a square frame, and a thermal insulating panel or a pane of glass 17 mounted in the square frame. Horizontally adjacent curtain wall units 10, 10 have their vertical members 14, 13 supported by the fastener 12 shared thereby and positioned between the adjacent curtain wall units 10, 10. Vertically adjacent curtain wall units 10, 10 are interconnected by a pair of connectors 18, 18 attached to the upper and lower horizontal members 15, 16.

Figure 3:
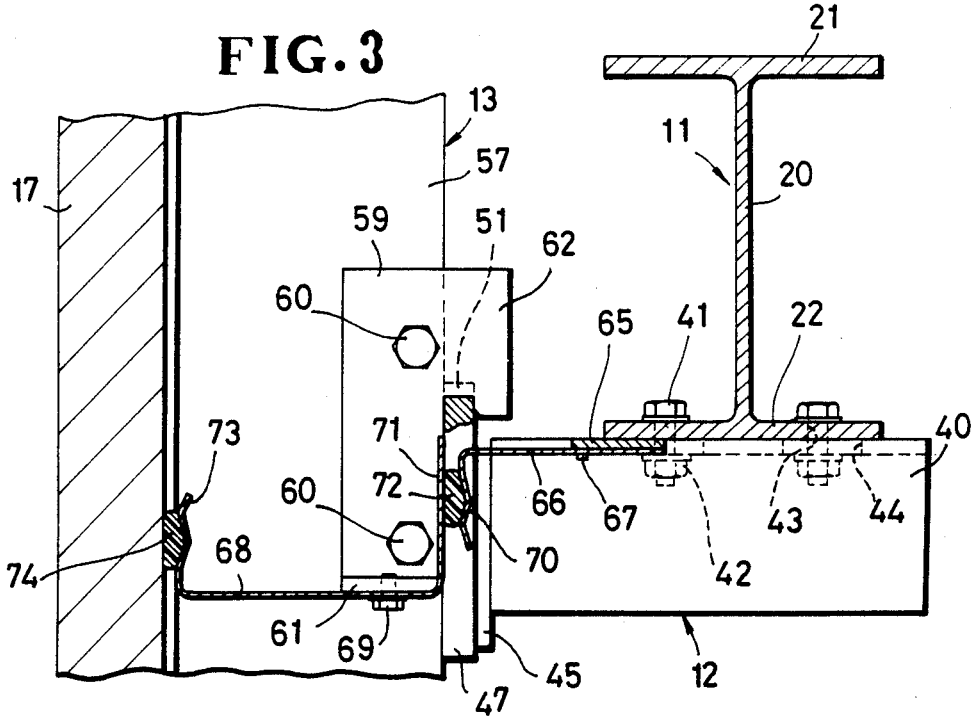
FIG. 3, appearing with FIG. 1, is an enlarged cross-sectional view taken along line III—III of FIG. 1.
Figure 2:
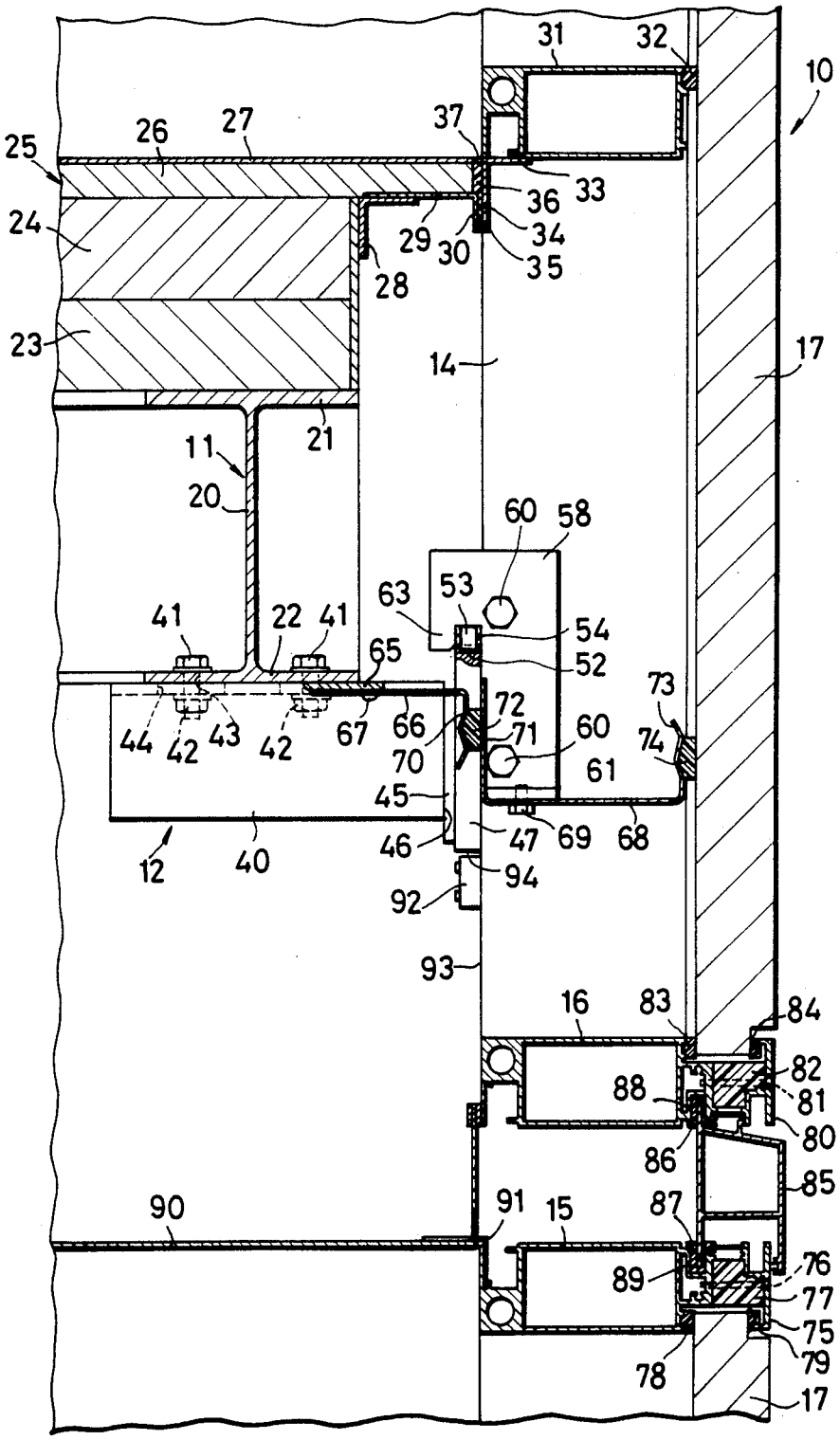
FIG. 2 is an enlarged cross-sectional view taken along line II—II of FIG. 1.

As shown in FIGS. 2 and 3, each of the building skeleton frame members 11 is a steel I-beam 20 including a pair of upper and lower flanges 21, 22. On the upper flange 21, there are stacked a deck plate 23, a slab of concrete 24, and a flooring 25 composed of a layer of mortar 26 and a floor panel 27. The mortar layer 26 and the concrete slab 24 are interconnected by an L-shaped bracket 28 with a partition strip 29 secured to the underside of the mortar layer 26. The partition strip 29 includes a vertical flange 30 extending downwardly in alignment with an outer end of the flooring 25.

A transverse frame member 31 (shown in FIG. 2 only) extends between the vertical frame members 13, 14 and is attached thereto, the panel 17 being disposed against an exterior face of the transverse frame member 31 with a gasket 32 interposed therebetween. An inverted L-shaped bracket 33 is secured to an inner lower marginal edge of the transverse frame member 31 and includes a vertical leg 34 which extends parallel to the vertical flange 30 of the partition strip 29. A gasket 35 is interposed between the vertical leg 34 and the vertical flange 30, and a backup material 36 is disposed between the outer edge of the mortar layer 25 and the vertical leg 35. A caulking material 37 is placed between the floor panel 27 and the vertical leg 35.

The fastener 12 is composed of a first channel-shaped fastener member 40 (FIGS. 2 through 4) secured to the lower flange 22 of the I-beam 20 by means of bolts 41 and nuts 42. The lower flange 22 has slots 43 extending longitudinally of the I-beam 20 parallel to the curtain wall units 10, and the first channel-shaped fastener member 40 has slots 44 extending transversely to the I-beam 20 perpendicularly to the curtain wall units 10. The bolts 41 extend through the slots 43, 44 with the nuts 42 threaded onto the bolts 41. Before the nuts 42 are tightened, the first fastener member 40 is positionally adjusted so that it will be located across the vertical frame members 13, 14 of the adjacent curtain wall units 10 and spaced properly from the vertical frame members 13, 14. After the first fastener member 40 has thus been positioned, the nuts 42 are tightened on the bolts 41.

An end plate 45 is welded to an outer surface 46 of the first fastener member 40. The fastener 12 also includes a second plate-shaped fastener member 47 fixed to the end plate 45 by bolts 48 (FIG. 4) and nuts (not shown), the bolts 48 extending through vertical slots 49 in the end plate 45. The second fastener member 47 can be vertically adjusted in position along the vertical slots 49. The second fastener member 47 has in its upper surface 50 a slot 51 disposed closely to one end thereof and a recess 52 disposed closely to an opposite end thereof. A bearing element or roller 53 is disposed in the recess 52, the roller 53 having a shaft 54 journalled in bearing grooves 55 in the second fastener member 47. The roller shaft 54 extends in a direction normal to the second fastener member 47 so that the roller 53 is rotatable in a plane parallel to the second fastener member 47 and hence the curtain wall units 10. The roller 53 has an upper peripheral surface projecting upwardly beyond the upper surface 50 of the second fastener member 47.

Figure 4:
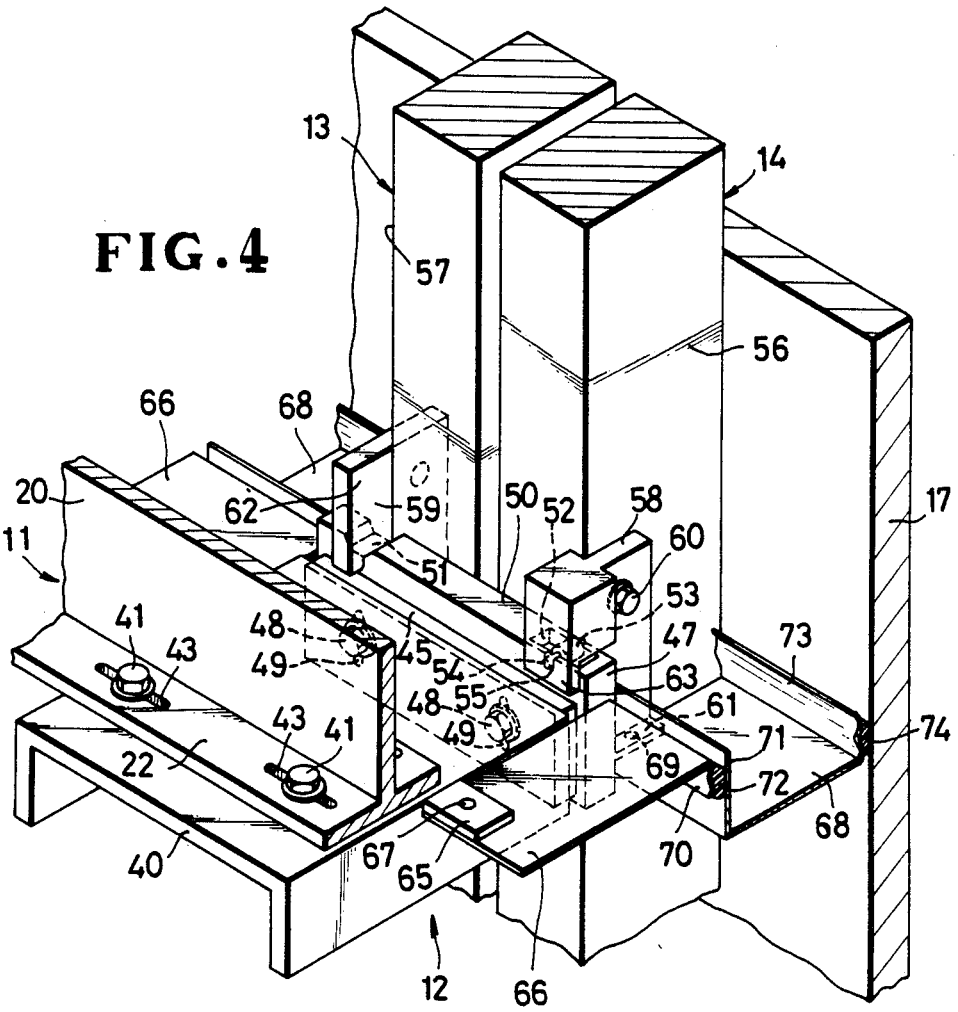
FIG. 4 is a fragmentary perspective view of a portion of the unit curtain wall having a fastener.

As best shown in FIG. 4, a pair of brackets 58, 59 is attached by bolts 60 to side surfaces 56, 57, respectively, of the adjacent vertical frame members 14, 13. Each of the brackets 58, 59 has a lower horizontal flange 61 (one shown). The bracket 59 includes a hooked arm 62 engaging in the slot 51 in the second fastener member 47, while the other bracket 58 has a hooked arm 63 placed on the roller 53. Thus, the vertical frame member 13 is fixedly hung by the second fastener member 47 against any movement perpendicular to and parallel to the curtain wall units 10, and the vertical frame member 14 is hung by the second fastener member 47 against any movement perpendicular to the curtain wall units 10, but is allowed to move in a plane parallel to the curtain wall units 10 by means of the roller 53.

An attachment plate 65 is welded to the underside of the lower flange 22 of the I-beam 20 in engagement with one of the ends of the first fastener member 40. An inner partition strip 66 is held by a screw 67 affixed to the attachment plate 65 and extends horizontally between the opposite ends of adjacent first fastener members 12. An outer partition strip 68 is affixed by a bolt 69 to the lower flange 61 of the bracket 58 and extends horizontally between the side surfaces 56, 57 of adjacent vertical frame members 14, 13. The inner partition strip 66 includes an outer downward flange 70, and the outer partition strip 68 includes an inner upward flange 71, there being a dry gasket 72 interposed between these flanges 70, 71. The outer partition strip 68 also includes an outer upward flange 73 facing the panel 17 with a dry gasket 74 disposed therebetween. These dry gaskets 72, 74 serve to prevent flames and smoke from passing through the gaps between the panel 17 and the I-beam 20 if a fire breaks out in the building.

As illustrated in FIG. 2, the upper end of the panel 17 of each curtain wall unit 10 is secured to the upper frame member 15 by a holder bar 75 fixed to the upper frame member 15 by screws 76 (one shown) with a thermally insulating connector 77 placed between the holder bar 75 and the upper frame member 15. The upper end of the panel 17 is sandwiched between lower edges of the holder bar 75 and the upper frame member 15 with gaskets 78, 79 interposed therebetween. Likewise, the lower end of the panel 17 is secured to the lower frame member 16 by a holder bar 80 fixed to the lower frame member 16 by screws 81 (one shown) with a thermally insulating connector 82 placed between the holder bar 80 and the lower frame member 16. The lower end of the panel 17 is sandwiched between upper edges of the holder bar 80 and the lower frame member 16 with gaskets 83, 84 interposed therebetween.

Between the upper and lower frame members 15, 16, there is a weathering board 85 attached by gaskets 86, 87 retained in slots 88, 89, respectively, disposed in the lower and upper frame members 15, 16, respectively.

A ceiling panel 90 is secured at its outer edge to the upper frame member 15 by a bracket 91 attached to an inner edge of the upper frame member 15.

A stop 92 is fastened to an inner side surface 93 of each of the vertical frame members 13, 14 and positioned in confronting relation to a lower surface 94 of the second fastener member 47 for limiting upward movement of the vertical frame member 13, 14 to a certain interval. The stop 92 is attached to the vertical frame member 13, 14 after the curtain wall 10 has been mounted on the fastener 12.

Figure 5:
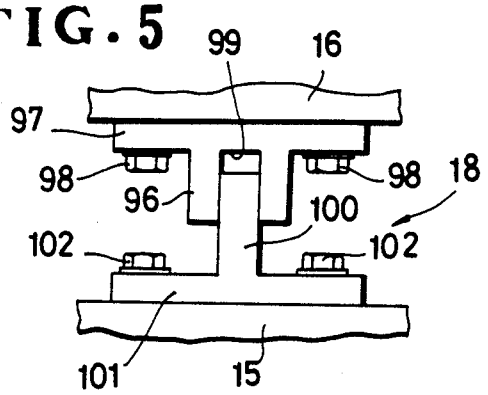
FIG. 5 is a fragmentary side elevational view of a connector.

As illustrated in FIG. 5, each of the connectors 18 is composed of an upper female member 96 including a base 97 fastened to the lower frame member 16 by bolts 98 and having a central slot 99, and a lower male member 100 including a base 101 fastened to the upper frame member 15 by bolts 102 and inserted in the central slot 99 for slidable movement therein parallel to the curtain wall units 10.

Figure 6:
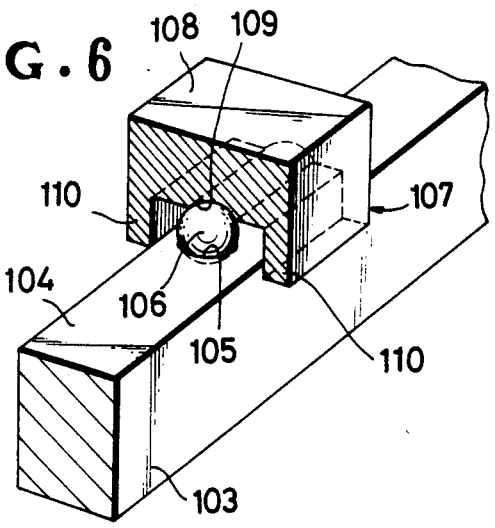
FIG. 6 is a fragmentary perspective view of a bearing element according to another embodiment of the present invention.

According to another embodiment shown in FIG. 6, a second fastener member 103 has an upper surface 104 with a partly spherical recess 105 defined therein, and a ball 106 is partly received rotatably in the recess 105. A bracket 107 which is fastened to a vertical frame member of a curtain wall unit has an arm 108 having a groove 109 disposed in a lower surface thereof, the groove 109 having a segmental cross section and extending parallel to the second fastener member 103. Thus, the bracket 107 and hence the vertical frame member attached thereto are allowed to move in a direction parallel to the curtain wall units.

With the foregoing arrangement, the vertical members 14 are horizontally movable on the rollers 53 (FIGS. 2 and 4) or the balls 106 (FIG. 6) with respect to the fasteners 12 for taking up any unwanted individual displacements of the curtain wall units 10 at the time of an earthquake, for instance, to thereby eliminate impact forces which would otherwise damage the curtain wall units 10. The fasteners 12 can be adjustably positioned on the building skeleton frame for proper alignment with the vertical frame members 13, 14 of the curtain wall units 10. Since each fastener 12 is shared by the adjacent curtain wall units 10, the overall number of fasteners 12 used is relatively small. The curtain wall units 10 can simply be mounted on the building frame through a relatively simple attachment construction including the fasteners 12 and the brackets 58, 59.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A unit curtain wall for a building frame, said wall comprising:

(a) a plurality of curtain wall units;

(b) a pair of brackets attached to horizontally adjacent edges of each pair of adjacent curtain wall units; and (c) a fastener adapted to be adjustably mounted on the building frame and having a slot receiving one of said brackets and a movable bearing element supporting the other bracket for allowing the latter to move in a direction substantially parallel to said curtain wall units.

2. A unit curtain wall according to claim 1, each of said curtain wall units including a pair of horizontally spaced vertical frame members, said brackets being secured to said vertical frame members of the adjacent curtain wall units.

3. A unit curtain wall according to claim 1, said brackets having arms extending in a direction normal to said curtain wall units, and fitted in said slot and engaging said bearing element, respectively.

4. A unit curtain wall according to claim 1, said fastener including an upper surface having a recess defined therein, said bearing element comprising a roller received in said recess for rotation in a plane aligned with said direction.

5. A unit curtain wall according to claim 1, said fastener including an upper surface having a partly spherical recess defined therein, said bearing element comprising a ball partly received in said recess for rotation in a plane aligned with said direction, said other bracket having a groove extending in said direction and partly receiving said ball.

6. A unit curtain wall according to claim 1, said fastener comprising a first fastener member adapted to be mounted on the building frame for positional adjustment in said direction in and a direction perpendicular thereto, and a second fastener member mounted on said first fastener member for vertical positional adjustment, said second fastener member having said slot and said bearing element.

7. A unit curtain wall according to claim 1, including connectors interconnecting said curtain wall units vertically, each of said connectors having a female member fastened to one of each pair of vertically adjacent curtain wall units and a male member fastened to the other of the vertically adjacent curtain wall units and inserted in said female member for slidable movement therein along said direction.

* * * * *